US011315531B1

(12) United States Patent
Tuk

(10) Patent No.: US 11,315,531 B1
(45) Date of Patent: Apr. 26, 2022

(54) DRUM PAD

(71) Applicant: J. Bryan Tuk, Kennett Square, PA (US)

(72) Inventor: J. Bryan Tuk, Kennett Square, PA (US)

(73) Assignee: grooveKSQ, LLC, Kennett Square, PA (US)

( * ) Notice: Subject to any disclaimer, the term of this patent is extended or adjusted under 35 U.S.C. 154(b) by 0 days.

(21) Appl. No.: 17/224,184

(22) Filed: Apr. 7, 2021

(51) Int. Cl.
*G10D 13/03* (2020.01)
*G10D 13/24* (2020.01)

(52) U.S. Cl.
CPC ..... *G10D 13/03* (2020.02); *G10D 13/24* (2020.02)

(58) Field of Classification Search
CPC ..... G10D 13/03; G10D 13/24
See application file for complete search history.

(56) References Cited

U.S. PATENT DOCUMENTS 2,495,495 A * 1/1950 Adler ..... G10D 13/03 84/411 R
2,565,225 A * 8/1951 Gladstone ..... G10D 13/02 84/411 R
3,597,520 A * 8/1971 Andrews ..... G10D 13/03 84/411 R
4,179,974 A * 12/1979 Trankle ..... G10D 13/03 84/411 P
4,406,207 A * 9/1983 Criscione ..... G10D 13/03 84/411 P
5,520,090 A * 5/1996 Eagle ..... G10D 13/03 84/411 P
5,932,823 A * 8/1999 Jacobs ..... G10D 13/03 84/411 P
6,362,407 B1 * 3/2002 Dennis ..... G10D 13/08 84/411 P
7,985,908 B1 * 7/2011 Howard ..... G10D 13/03 84/411 P
9,245,504 B1 * 1/2016 McSweeney ..... G09B 15/026
2009/0241754 A1 * 10/2009 Okada ..... G10D 13/26 84/414
2010/0282048 A1 * 11/2010 Hashimoto ..... G10D 13/26 84/743
2015/0371617 A1 * 12/2015 Chiappe ..... G10D 13/03 84/411 P

* cited by examiner

*Primary Examiner* — Robert W Horn
(74) *Attorney, Agent, or Firm* — Joseph E. Maenner; Maenner & Associates, LLC

(57) ABSTRACT

A drum pad includes a base portion having a top base surface and constructed from a first material. A strike portion having a top strike surface is defined by a perimeter. The perimeter is totally surrounded by the base portion. The strike portion is constructed from a second material, different from the first material. The top base surface and the top strike surface are co-planar.

20 Claims, 3 Drawing Sheets

100
156
152
110
120
122
114A
124
116
115
113
150
112
114C
114B 110
111
130
116
132

DRUM PAD

BACKGROUND OF THE INVENTION

Field of the Invention

The present invention relates to a drum pad that can be played on a flat surface or releasably attached to a snare drum stand.

Description of the Related Art

Practice pads are used by drummers to practice their stick work when a drum is not available or practical to use. Practice pads are typically placed on a flat surface and drummed upon. Some practice pads are angled to simulate the angle that drummers often use for their snare drum as part of a kit. A drawback to these pads, however, is that the height and the angle of the surface relative to the drummer may not be optimal, which can result in poor practice performance.

It would be beneficial to provide a practice pad that can be attached to a snare drum stand so that the height and the angle of the pad can be adjusted by adjusting the height and angle of the snare drum stand.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a drum pad comprising a base portion having a top base surface and constructed from a first material. A strike portion having a top strike surface is defined by a perimeter. The perimeter is totally surrounded by the base portion. The strike portion is constructed from a second material, different from the first material. The top base surface and the top strike surface are co-planar.

In an alternative embodiment, the present invention is a drum pad comprising a base portion having a cutout formed therein and a top base surface extending around the cutout and a generally circular outer perimeter having a plurality of indents spaced around the perimeter. A strike portion is positioned in the cutout and has a strike surface.

In still another alternative embodiment, the present invention is a drum pad comprising a base portion having a perimeter portioned into three identical portions. Each perimeter portion comprises a first portion having a first convex radius; a pair of second portions having a second convex radius, with each of the second portions extending from opposing ends of the first portion; and a pair of third portions having a concave radius, with each of the third portions extending from one of the second portions. A strike portion is inside the base portion.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 1:
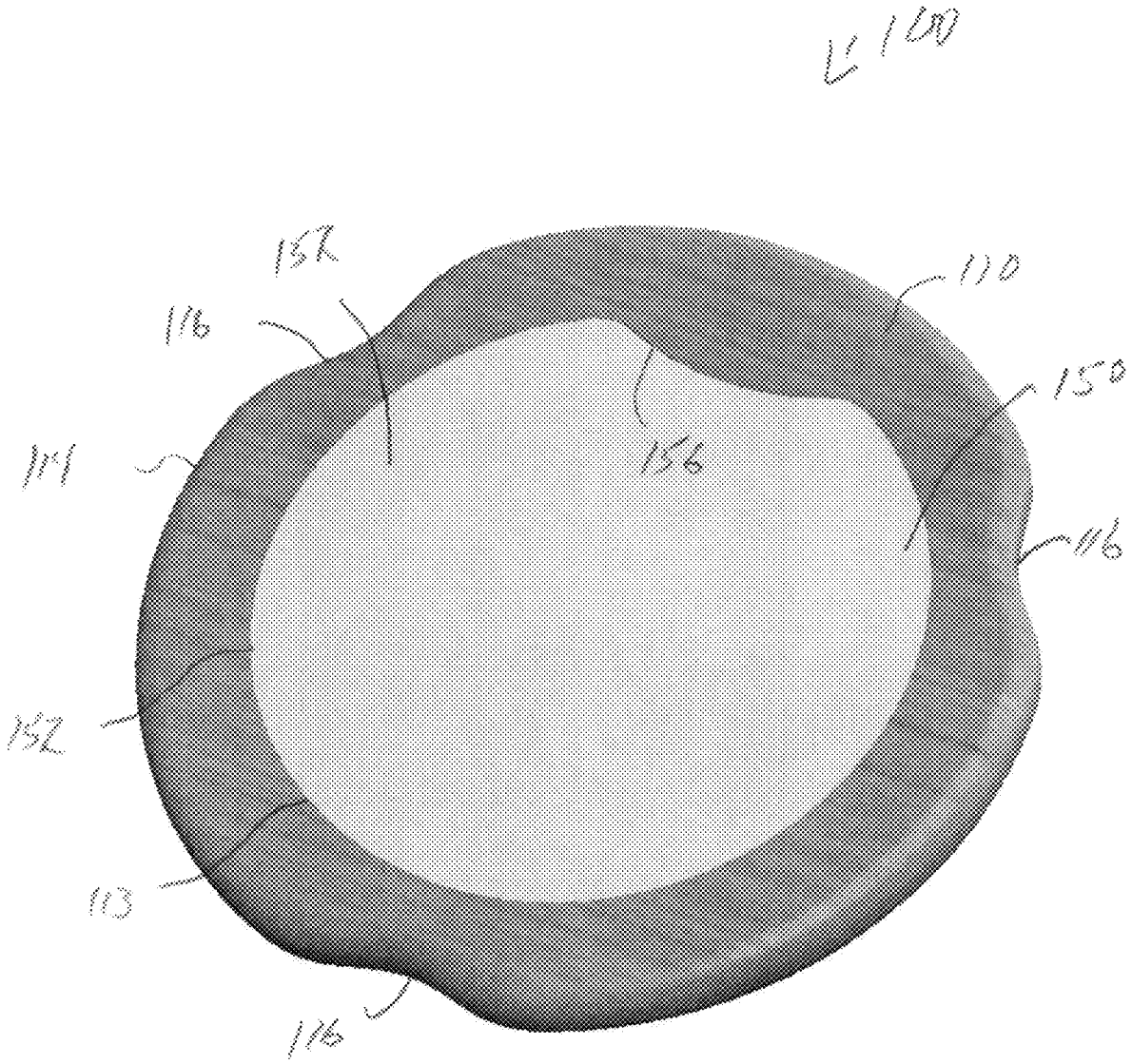
FIG. 1 is a perspective view of a drum pad according to an exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

The word "about" is used herein to include a value of +/−10 percent of the numerical value modified by the word "about" and the word "generally" is used herein to mean "without regard to particulars or exceptions."

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

The present invention provides a drum pad that can be alternatively placed on a flat surface or supported by the three arms of a typical snare drum stand (not shown). Referring to FIGS. 1-7, drum pad 100 has a base portion 110 having a top base surface 112 with a cutout 113 formed therein such that top base surface 112 extends around cutout 113 to receive and retain a strike portion 150 inlaid inside base portion 110. Top base surface 112 extends in a first plane.

Base portion 110 can be constructed from a first material, such as, for example, wood, a hard polymer, or other hard synthetic material. Base portion 110 has a generally circular base portion perimeter 114 (as identified by the circle 115 in broken lines in FIG. 2) such that base portion perimeter 114 has a plurality of indents 116 spaced therearound. In an exemplary embodiment, indents 116 are evenly spaced apart from each other around base portion perimeter 114. In an exemplary embodiment, three indents 116 are provided, with adjacent indents 116 spaced 120 degrees around base perimeter 114 from each adjacent indent 116.

Figure 2:
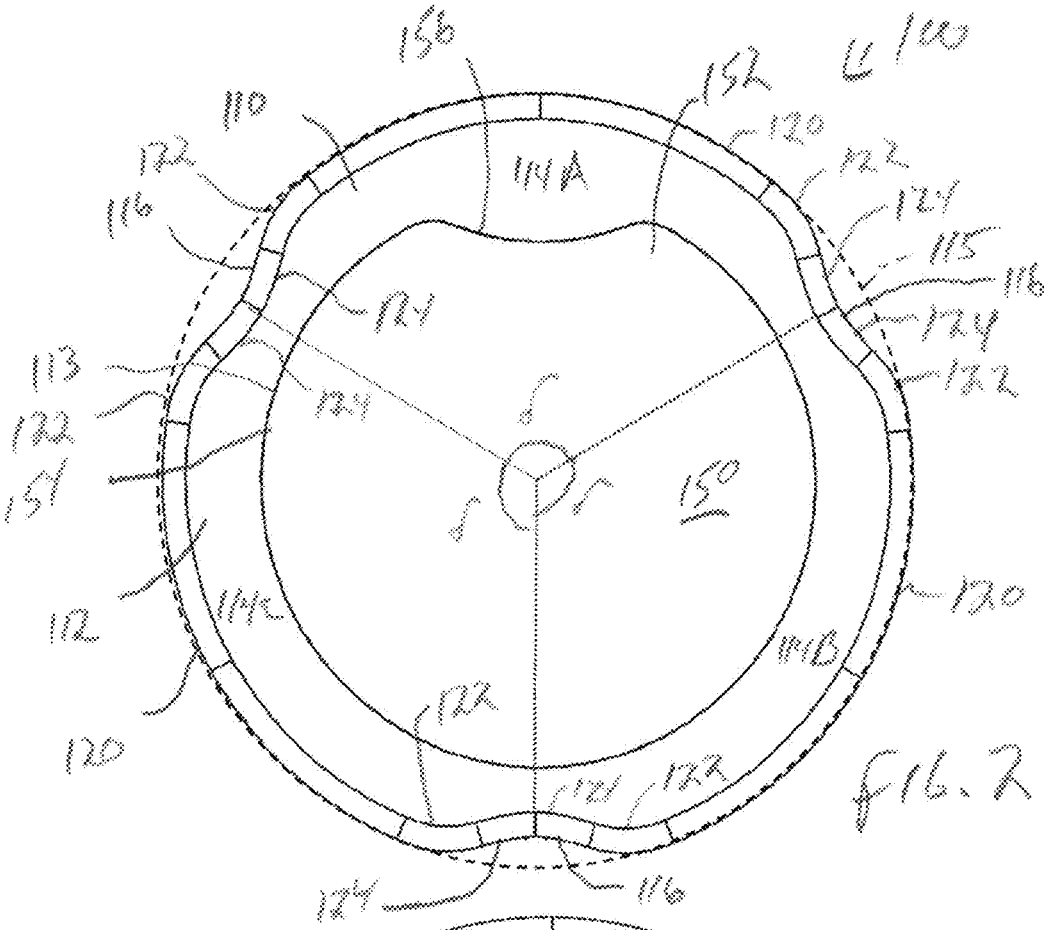
FIG. 2 is a top plan view of the drum pad of FIG. 1.

Base portion perimeter 114 can be portioned into a plurality of identical perimeter portions 114A, 114B, 114C, as shown in FIG. 2. In this exemplary embodiment, three perimeter portions 114A, 114B, 114C are provided, to coincide with the number of support arms on a snare drum stand. Each perimeter portion 114A, 114B, 114C defines an angle δ of 120 degrees.

Each perimeter portion 114A, 114B, 114C comprises a first portion 120 having a first convex radius; a pair of second portions 122 having a second convex radius, such that each of the second portions 122 extends from opposing ends of the first portion 120; and a pair of third portions 124 having a concave radius, each of the third portions 124 extending from one of the second portions 122. One of the third portions 124 from one of the perimeter portions 114A, 114B, 114C engages one of the third portions 124 from one of the other perimeter portions 114A, 114B, 114C. By way of example, third portion 124 from perimeter portion 114A engages third portion 124 of perimeter portion 114C.

As used herein, the term "convex" is applied to an arc that defines an outside arc or a circle and the term "concave" is applied to an arc that defines an inside arc of a circle.

Figure 3:
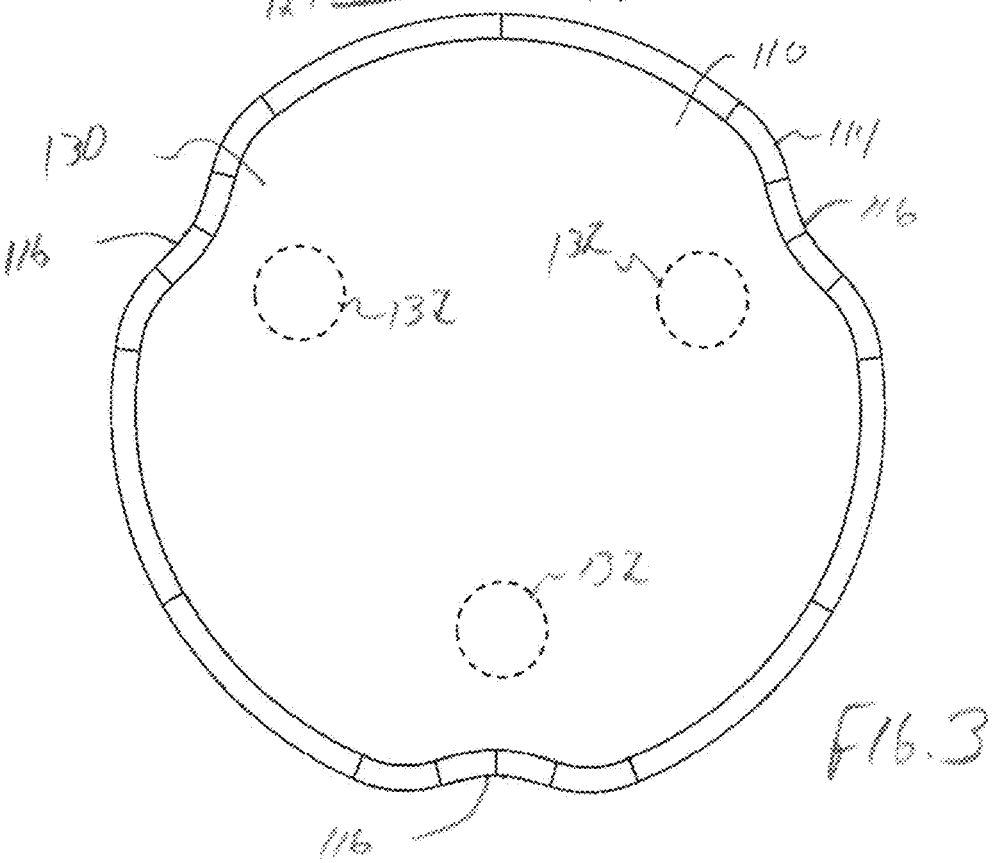
FIG. 3 is a bottom plan view of the drum pad of FIG. 1.
Figure 4:
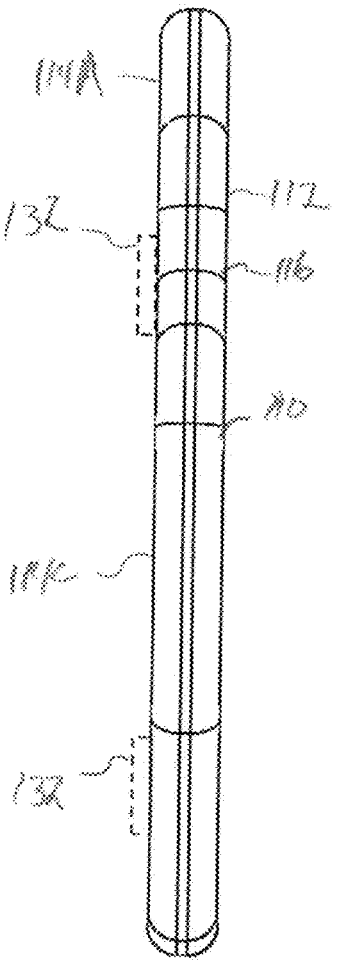
FIG. 4 is a left side elevational view of the drum pad of FIG. 1.
Figure 5:
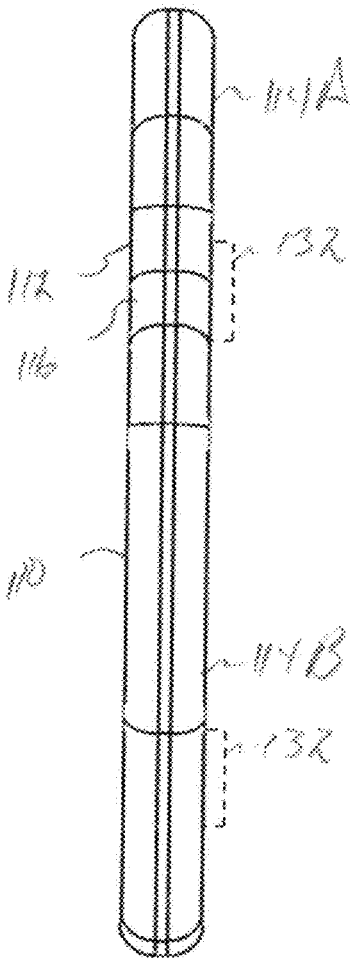
FIG. 5 is a right side elevational view of the drum pad of FIG. 1|
Figure 6:
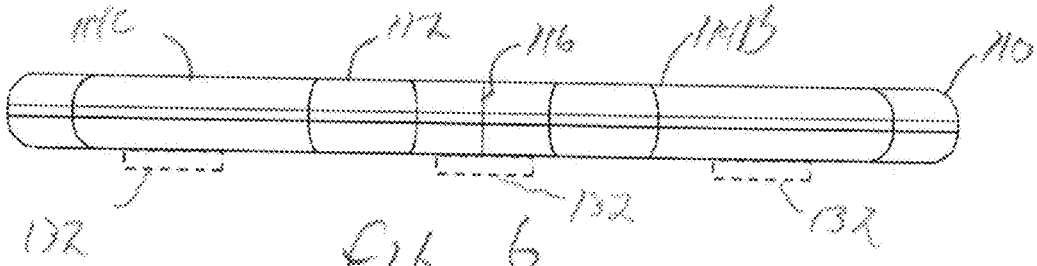
FIG. 6 is a front elevational view of the drum pad of FIG. 1.
Figure 7:
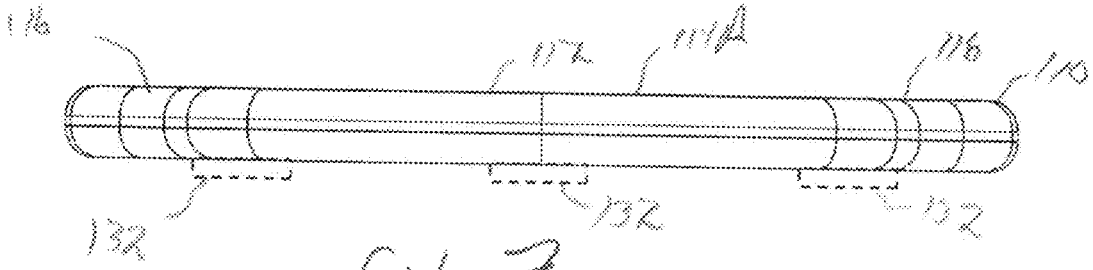
FIG. 7 is a rear elevational view of the drum pad of FIG. 1.

A bottom surface 130 of base portion 110, shown in FIG. 3, can include a plurality of feet 132 so that, when drum pad 100 is placed on a flat surface (not shown), feet 132 engage the surface.

Strike portion 150 has a top strike surface 152 defined by a perimeter 154. Perimeter 154 is totally surrounded by base portion 110. Strike portion 150 constructed from a second material, different from the first material, and can be constructed from a soft polymer, rubber, or other soft synthetic material. It is desired that the second material is softer than the first material and has a larger resiliency than the first material.

In an exemplary embodiment, strike surface 152 can be generally circular, although those skilled in the art will recognize that strike surface 152 can take other shapes. In an exemplary embodiment, strike surface 152 has a cutout 156 that results in a portion of top base surface 112 that can be used to apply a logo, a trademark, or other type of indicia (not shown).

Top base surface 112 and the top strike surface 152 are co-planar so that, when a drummer misses top strike surface 152 with a stick and instead hits both top strike surface 152 and top base surface 112, the stick does not deflect at an angle as it likely would if stop strike surface 152 was in a separate plane above the plane of top base surface 112 and the stick hit the edge of top strike surface 152.

It will be further understood that various changes in the details, materials, and arrangements of the parts which have been described and illustrated in order to explain the nature of this invention may be made by those skilled in the art without departing from the scope of the invention as expressed in the following claims.

I claim:

1. A drum pad comprising:

a base portion having a top base surface and constructed from a first material;

a strike portion having a top strike surface defined by a perimeter, the perimeter totally surrounded by the base portion, the strike portion constructed from a second material, different from the first material, wherein the top base surface and the top strike surface are co-planar.

2. The drum pad according to claim 1, wherein the base portion has a generally circular base portion perimeter, wherein the base portion perimeter has a plurality of indents spaced there around.

3. The drum pad according to claim 2, wherein the indents are evenly spaced apart from each other.

4. The drum pad according to claim 2, wherein the indents comprise three indents.

5. The drum pad according to claim 4, wherein the indents are spaced 120 degrees around the base perimeter from each adjacent indent.

6. The drum pad according to claim 1, wherein the base portion is constructed from a wood.

7. The drum pad according to claim 1, wherein the top strike surface is constructed from a polymer.

8. A drum pad comprising:

a base portion having a cutout formed therein and a top base surface extending around the cutout and a generally circular outer perimeter having a plurality of indents spaced around the perimeter; and a strike portion positioned in the cutout, the strike portion having a strike surface.

9. The drum pad according to claim 8, wherein the top base surface and the strike surface are co-planar.

10. The drum pad according to claim 8, wherein the plurality of indents are evenly spaced around the perimeter.

11. The drum pad according to claim 8, wherein the indents comprise three indents.

12. The drum pad according to claim 11, wherein the indents are evenly spaced from adjacent indents.

13. The drum pad according to claim 8, wherein the base portion is constructed from a first material and the strike portion is constructed from a second material, different from the first material.

14. The drum pad according to claim 13, wherein the second material has a larger resiliency than the first material.

15. A drum pad comprising:

a base portion having a perimeter portioned into a plurality of identical perimeter portions, each perimeter portion comprising:

a first portion having a first convex radius;

a pair of second portions having a second convex radius, each of the second portions extending from opposing ends of the first portion; and a pair of third portions having a concave radius, each of the third portions extending from one of the second portions; and a strike portion inside the base portion.

16. The drum pad according to claim 15, wherein the plurality of identical portions comprises three portions.

17. The drum pad according to claim 15, wherein one of the third portions from one of the perimeter portions engages one of the third portions from one of the other perimeter portions.

18. The drum pad according to claim 15, wherein the strike portion has a top strike surface extending in a first plane and wherein the base portion has a top base surface extending in a second plane, coplanar with the first plane.

19. The drum pad according to claim 15, wherein the base portion is constructed from a wood.

20. The drum pad according to claim 15, wherein the top strike surface is constructed from a polymer.

* * * * *